US006417431B1

(12) United States Patent
Wilkinson

(10) Patent No.: US 6,417,431 B1
(45) Date of Patent: Jul. 9, 2002

(54) GRIPICK

(75) Inventor: Clark Wilkinson, Whitethorn, CA (US)

(73) Assignee: Clark A. Wilkinson, Whitethorn, CA (US)

( * ) Notice: Subject to any disclaimer, the term of this patent is extended or adjusted under 35 U.S.C. 154(b) by 0 days.

(21) Appl. No.: 09/735,133

(22) Filed: Dec. 11, 2000

Related U.S. Application Data

(60) Provisional application No. 60/170,703, filed on Dec. 14, 1999.

(51) Int. Cl.[7] ..... G10D 3/16

(52) U.S. Cl. ..... 84/322; 84/320

(58) Field of Search ..... 84/322, 320

(56) References Cited

U.S. PATENT DOCUMENTS

| | | | | | |
|---|---|---|---|---|---|
| 1,184,561 | A | * | 5/1916 | Napoletano | 84/322 |
| 1,461,070 | A | * | 7/1923 | Rudesyle | 84/322 |
| 5,307,723 | A | * | 5/1994 | De La Rosa | 84/322 |
| 5,643,519 | A | * | 7/1997 | Mauro et al. | 264/219 |
| 5,648,622 | A | * | 7/1997 | Storey | 84/322 |

* cited by examiner

*Primary Examiner*—Shih-Yung Hsieh

(57) ABSTRACT

A guitar pick or plectrum used for playing stringed musical Instruments. The pick has a generally oval triangular configuration. The pick grip pattern consists of a grip at the top of the pick which is a trademark that protrudes above the surface of the pick. The pick also incorporates a circular bevel region surrounding a center hole with a plurality of grip protrusions protruding from the bevel region. The flexibility of the pick may be adjusted by the material injected in a liquid injection mold manufacture process in conjunction with overall pick thickness.

1 Claim, 1 Drawing Sheet

FIG. 1
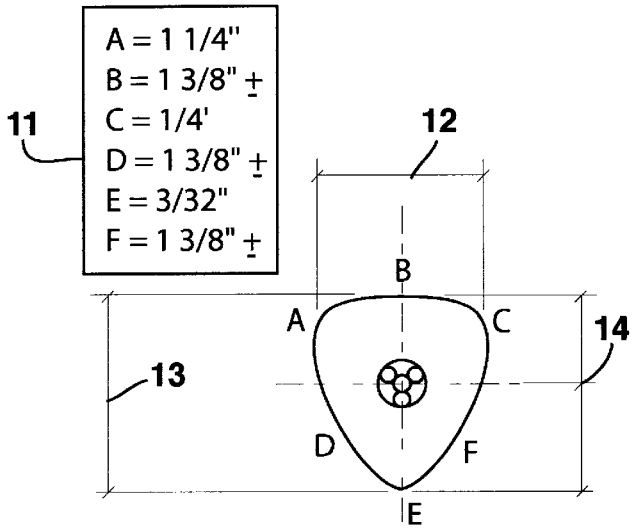
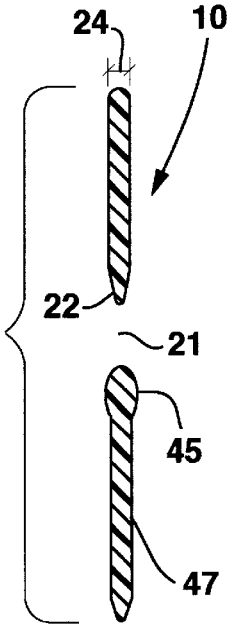
FIG. 2
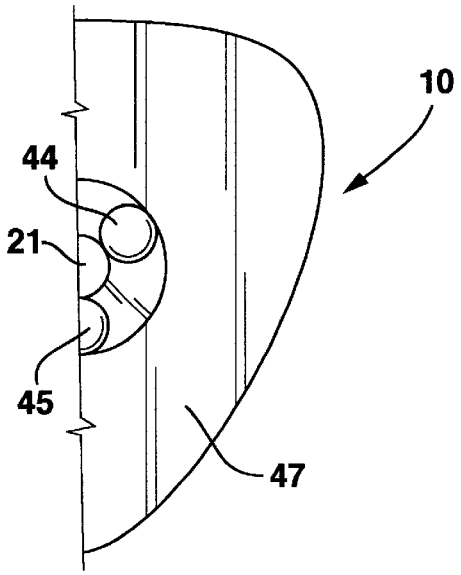
FIG. 3
FIG. 4
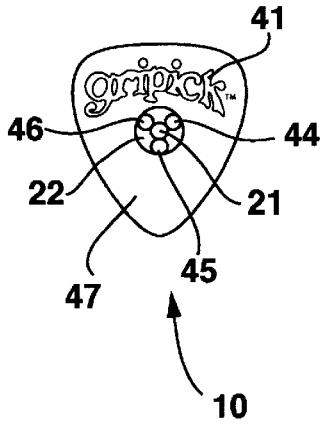

GRIPICK

CROSS-REFERENCE TO RELATED APPLICATIONS

This application is an amendment to Ser. No. 60/170,703 filed Dec. 14, 1999 and application Control # 09/735,133 filed Dec. 11, 2000.

BACKGROUND OF THE INVENTION

1. Field of the invention

The present invention relates to guitar picks or plectrums that are used in plucking the strings of musical instruments which are members of the lute family. Such as guitars, bass guitars, ukuleles and mandolins. When playing it is preferred to retain a grasp upon the plectrum. The pick according to the present invention is an improved grip design.

2. Description of the prior art

There are a variety of picks that offer the player improved grip designs for a variety of reasons. The standard stamped or molded plastic pick designs are flat in design and vary in shape and material and have a glossy slippery finish. A recognized difficulty with this type of pick is its tendency to slip from the player's fingers especially when the pick becomes slick from sweat. Attempts have been made to eliminate the chance of dropping the pick while playing stringed instruments.

For example U.S. Pat. No. 1,117,056 entitled "musical instrument pick" that was issued Nov. 10, 1914 on an application filed in the name of Louis C. Knackestedt discloses a plurality of openings that receive rubber plugs that allow more grip upon the pick. U.S. Pat. No. 3,112,668 entitled "Instrument for playing Guitars, Banjos and the Like" that was issued Dec. 3, 1963, on an application filed in the name of Joseph MoShay, discloses a pick that has a hole in the center that in-use allows the index finger to touch the thumb.

SUMMARY OF INVENTION

It is the object of the present invention to provide a pick or plectrum, to be used while playing a stringed musical instrument that will allow the player the ability to retain a grasp of the pick or plectrum thereby eliminating the chance of dropping it. The pick is held between the thumb and index finger of a player of a stringed musical instrument. The grip pattern of the present invention is comprised of said trademark which protrudes above the surface and incorporates a circular bevel region surrounding a center hole along with a plurality of grip protrusions from said bevel region enabling the player to retain a firm grasp upon the pick.

BRIEF DESCRIPTIONS OF THE SEVERAL VIEWS OF THE DRAWINGS

FIG. 1 is a frontal plan view depicting pick dimensions.

FIG. 2 is a side plan view respectively of a preferred embodiment of the pick according to the invention.

FIG. 3 is a front al plan right side in proportion to side plan view FIG. 2 respectively, of a preferred embodiment of the pick according to the invention.

FIG. 4 is a frontal plan view depicting grip pattern respectively of a preferred embodiment of the pick according to the invention.

DETAILED WRITTEN DESCRIPTION

FIG. 1 shows a pick or plectrum's overall dimensions. The pick has a generally oval triangular configuration 11, 12, 13 and 14. In accordance with the present invent ion referred to by the general reference character 10. FIG. 2, depicts pick thickness 24, bevel 22, center hold grip 21, grip protrusion@ 180° 45. FIG. 3 depicts center hold grip 21, grip protrusion@ 60° 44. FIG. 4 depicts the specific improvement to a preferred embodiment. The increased grip of the pick comprised of a grip at the top, said Trademark 41, further comprised of a circular bevel region 22. The unitary pick may be made from a variety of materials including nylon or deldrin, a material suitable for manufacture into the unitary picks, using a liquid injection mold manufacture process flexibility may be adjusted by the material injected in conjunction with overall pick thickness 24.

What is claimed is:

1. A guitar pick comprising a grip at a top of the pick, said grip is a trademark protruding above a surface of said pick; said pick further comprising a circular bevel region surrounding a center hole of said pick, a plurality of grip protrusions protrude from said bevel region.

* * * * *